US005735659A

United States Patent [19]

Kosasa et al.

[11] Patent Number: 5,735,659

[45] Date of Patent: Apr. 7, 1998

[54] BINDING APPARATUS WITH SPINE COVER PRINTING APPARATUS

[75] Inventors: Hideaki Kosasa, Tokyo; Toshihiko Kusumoto, Yokohama; Yoshimasu Yamaguchi, Kawasaki; Hiroshi Ota, Tokyo; Yuji Yamanaka, Kawasaki; Kozo Sakakibara, Yokohama, all of Japan

[73] Assignee: Canon Kabushiki Kaisha, Tokyo, Japan

[21] Appl. No.: 528,416

[22] Filed: Sep. 14, 1995

[30] Foreign Application Priority Data

Sep. 14, 1994 [JP] Japan ..... 6-248506
Sep. 16, 1994 [JP] Japan ..... 6-221751

[51] Int. Cl.[6] ..... B42B 9/00

[52] U.S. Cl. ..... 412/9; 412/11; 412/16; 412/19; 412/33

[58] Field of Search ..... 412/9, 11, 12, 412/14, 16, 18, 19, 20, 33, 37; 281/29, 36, 37, 21.1

[56] References Cited

U.S. PATENT DOCUMENTS

| | | | |
|---|---|---|---|
| 4,072,326 | 2/1978 | Groswith, III et al. | 281/29 |
| 4,723,129 | 2/1988 | Endo et al. . | |
| 4,740,796 | 4/1988 | Endo et al. . | |
| 4,974,877 | 12/1990 | Azzatto | 412/9 |
| 5,174,556 | 12/1992 | Taylor et al. | 270/1.1 |
| 5,177,548 | 1/1993 | Nakamura et al. | 355/324 |
| 5,250,985 | 10/1993 | Ishii et al. | 412/11 X |
| 5,288,192 | 2/1994 | Ito et al. | 412/11 X |
| 5,319,470 | 6/1994 | Shukunami | 358/451 |
| 5,461,459 | 10/1995 | Muramatsu et al. | 412/11 X |
| 5,537,518 | 7/1996 | Hasegawa | 395/117 |
| 5,569,011 | 10/1996 | Yamaguchi et al. | 412/9 |

FOREIGN PATENT DOCUMENTS

| | | | |
|---|---|---|---|
| 232465 | 1/1986 | German Dem. Rep. | 412/14 |
| 130191 | 6/1991 | Japan | 412/14 |
| 91/04456 | 4/1991 | WIPO | 412/14 |

*Primary Examiner*—Frances Han
*Attorney, Agent, or Firm*—Fitzpatrick, Cella, Harper & Scinto

[57] ABSTRACT

A bookbinding apparatus includes pasting means for pasting a bookbinding spine cover sheet on a sheet set; printing means for printing an image on the bookbinding spine sheet; and inputting means for inputting data to be used for printing the image by the printing means; wherein when the data are inputted through the inputting means, the sizes of the image to be printed on the bookbinding spine cover sheet by the printing means can be optionally selected.

18 Claims, 10 Drawing Sheets

FIG. 2A
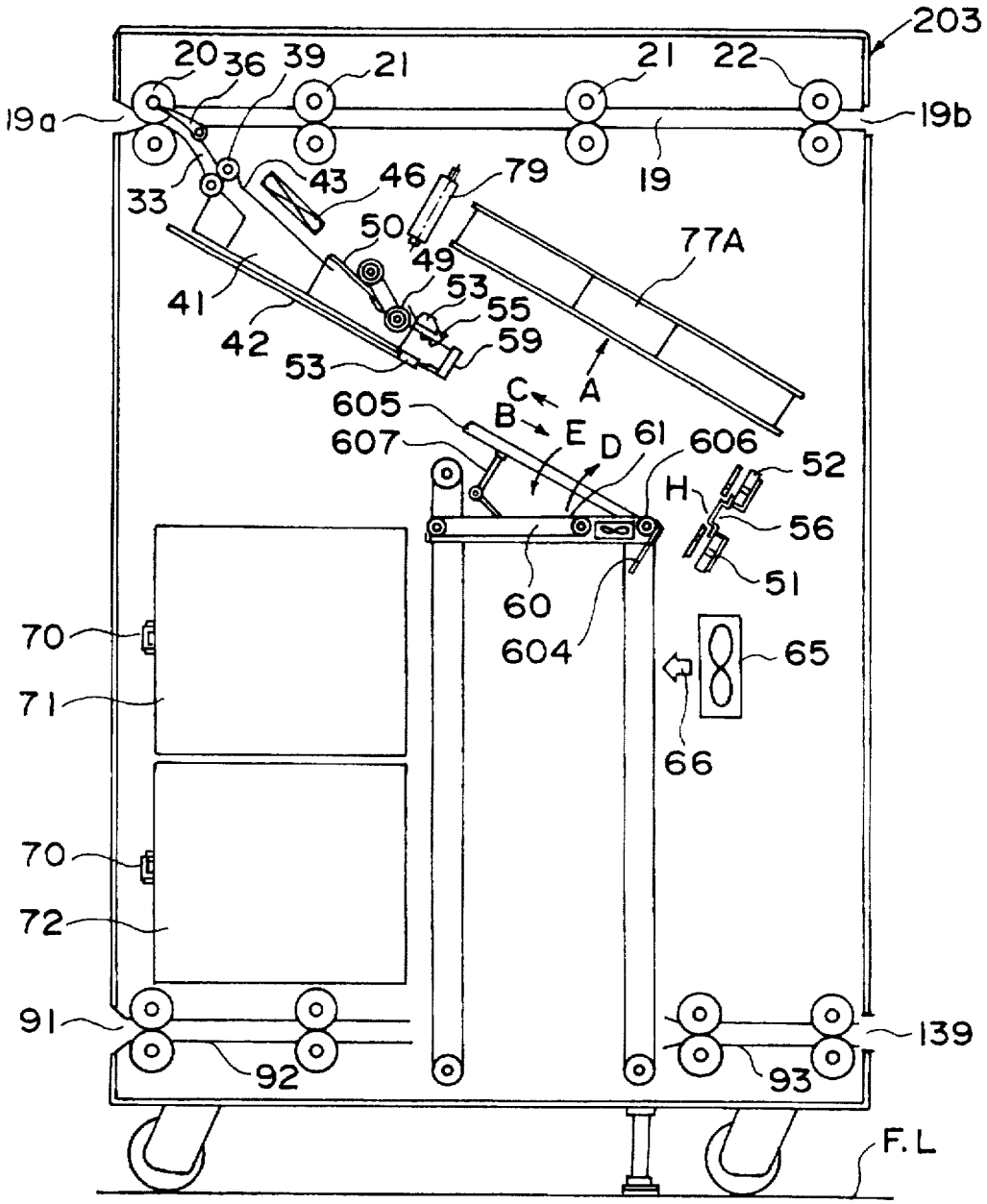
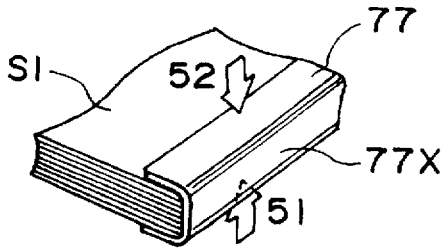
FIG. 2B

77b
THICKNESS
PRINT 83
77b
83
S2
90
91
83
S1
L2
L1
85
83
79
83
84
77a
Δ
81
77
80
82
77A
77c
56

BINDING APPARATUS WITH SPINE COVER PRINTING APPARATUS

FIELD OF THE INVENTION AND RELATED ART

The present invention relates to a book making apparatus with a spine cover printing apparatus. More specifically it relates to a book making apparatus comprising a printer capable of printing letters or the like on the spine cover before or after a set of sheets are bound.

As for a book making apparatus capable of printing letters, logos, or the like on the spine cover while binding a book, the one proposed in U.S. Pat. No. 5,174,556 has been known. According to this patent, a book making apparatus comprises an image forming apparatus, and a bookbinding apparatus which is directly connected to the image forming apparatus. In this apparatus, sheets, on which the images read from originals or the like have been printed by the image forming apparatus, are accumulated as a set, and finished in the farm of a book by means of binding them with a piece of binding tape, on which the data pertaining to the set of sheets are printed, at one of the edges of the set.

Referring to FIG. 2 of the '556 patent, the mechanism for printing on the spins cover is as follows. A binding tape 34 supported on a binding tape supply reel 33 is delivered to an ink jet printer 36 by a roller 35 and tension roller 35*a*. In the printer 36, necessary data are printed on the binding tape 34, and then the tape 34 is sent to a cutter 43 by a roller 40, where it is cut into a piece of binding tape 34 with an appropriate length. This piece of binding tape 34 is delivered to the tape holding member 45 of a bidding section for binding the sheet set.

The sheet set is bound by the piece of the binding tape on which the data have been printed.

However, the number of the sheets to be bound by the on-line binding apparatus varies depending on the number of the sheets in the original or the like, changing thereby the thickness of the sheet set to be bound, which in turn changes the width of the spine cover, As a result, when the sheet set is thin, there is a problem in that the spine cover surface is not large enough to accommodate the printed letters or logos, ruining the appearance of the finished book. Also, when the letters or logos are printed after binding, they can be only partially printed.

SUMMARY OF THE INVENTION

Accordingly, the primary object of the present invention is to provide a book making apparatus capable of preferably printing letters, logos, or the like on the spine cover surface even when the thickness of a sheet set to be bound changes.

According to an aspect of the present invention, there is provided a bookbinding apparatus comprising pasting means for pasting a bookbinding spine cover sheet on a sheet set; printing means for printing an image on the bookbinding spine sheet: and inputting means for inputting data to be used for printing the image by said printing means; wherein when the data are inputted through said inputting means, the sizes of the image to be printed on the bookbinding spine cover sheet by said printing means is selectable.

According to another aspect of the present invention, there is provided an on-line book making apparatus, which comprises an external device connected to a bookbinding apparatus, end controls said bookbinding apparatus, on the basis of the input from the inputting means of said external device, said bookbinding apparatus comprising pasting means for pasting a bookbinding spine cover sheet on a sheet set; and printing means for printing an image on the bookbinding spine sheet; wherein when data to be used for printing the image by said printing means are inputted through said inputting means, the sizes of the image to be printed on the bookbinding spine cover sheet by said printing means is selectable.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 2(*a*) and 2(*b*) are detailed drawings of the book making apparatus, wherein (a) is a sectional side view, and (b) is a perspective view.

DESCRIPTION OF THE PREFERRED EMBODIMENTS

Hereinafter, the embodiments of the present invention will be described referring to to drawings.

Figure 1:
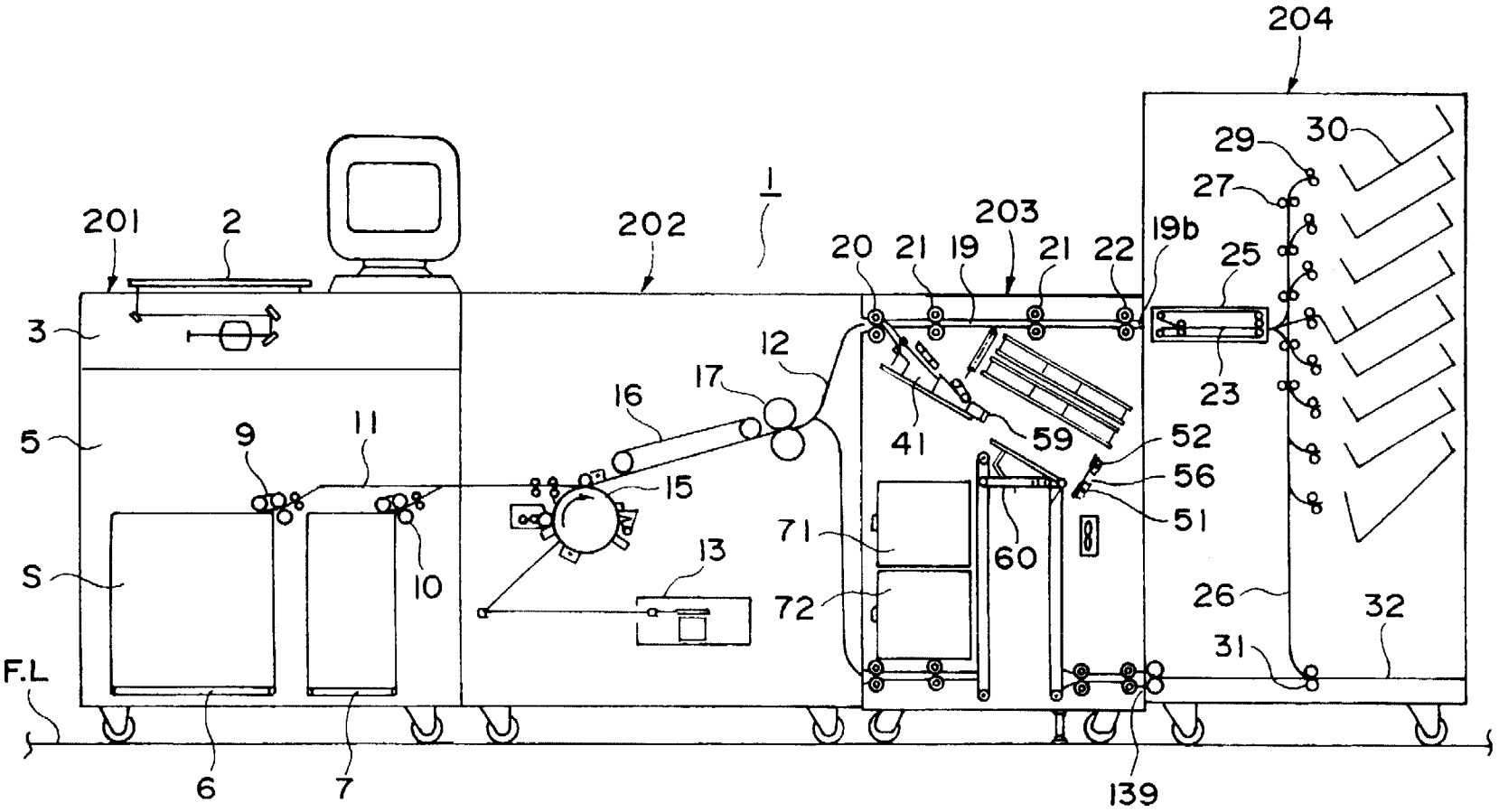
FIG. 1 is a sectional side view of an embodiment of an on-line apparatus in accordance with present invention.

FIG. 1 is a sectional side view of the on-line apparatus which best displays the characteristic of the resent invention. In this drawing, a reference numeral 1 designates an on-line apparatus comprising a reading/sheet feeding apparatus 201, an image forming apparatus 202, a binding apparatus 203, and a sorting apparatus 204, which are connected in a predetermined manner.

The reading/sheet feeding apparatus 201 comprises an original placement table 2 on which an unillustrated original is placed, and an optical system 3 which reeds the original by scanning it. The original placement table 2 and optical system 3 are disposed in the top portion of the apparatus 201. The reading/sheet feeding apparatus 201 also comprises a plurality of sheet feeding decks 6 sad 7, and sheet feeding sections 9 and 10 which feed out the sheets S from the sheet feeding decks 6 and 7, respectively. The decks 6 and 7 hold sheets 8 of different sizes. The decks 6 and 7, and the sheet feeding sections 9 and 10 are disposed in the bottom portion of the apparatus.

The sheet S fed out of the deck is conveyed to a sheet conveying path 12 of the image forming apparatus 202, through a Sheet conveying path 11. A reference numeral 13 designates a laser scanner, which scans the image forming surface with a laser beam carrying the image forming data read by the optical system 3, and a reference numeral 15 designates the image forming surface, on which a toner image is formed by the scanning laser beam from the laser scanner 13. The sheet 8 on which an image has been transferred from the image forming surface 15 is delivered by a conveyer belt 16, a pair of conveyer rollers 17, to a sheet conveying path 19 of the binding apparatus 203 connected on the downstream side of the image forming apparatus.

The binding apparatus 203 comprises a sheet aligning tray 41 for aligning and storing the sheets S having been delivered through the sheet conveying path 19, an aligning wall 59 against which the sheet edge are bumped, a tape heating apparatus 56 for heating the aligned sheets and the binding tape, a vertically movable carriage 60 for conveying finished books, stackers 71 and 72 for storing the finished books, and the like. It Should be noted here that the binding tape is coated with thermally meltable adhesive, on one surface (adhesive surface), and is adhered to the sheet set by means of heating.

In a sorting/storing apparatus 204, a reference numeral 25 designates an elevator for delivering the sheet S having conveyed through sheet conveying path 23, to a conveying path 26; 27, a pair of conveyer rollers disposed at corresponding branching points of the conveying path 26; and 29 designates a discharge roller pair for discharging the sheets S having sorted through the branching points, into the corresponding discharge trays 30. The finished products discharged from the binding apparatus 203 can be discharged from a discharge opening 32 by way of the elevator 25 and a conveyer roller pair 31.

When the sorting/storing apparatus 204 is not connected to the binding apparatus 203, an accumulator tray (unillustrated) for accumulating the discharged sheets is connected to a first discharge opening **19*b*, and an accumulation tray (unillustrated) for accumulating the discharged finished products is connected to a second discharge opening 139**.

Next, referring to FIG. 2(*a*), the binding apparatus 203 will be described in detail.

In the drawing, the binding apparatus 203 has a sheet conveying path 19 for conveying the sheet S delivered from the image forming apparatus 202. One end of the sheet conveying path is a first entrance **19*a*, and the other end is a first discharge opening 19*b*. Along the sheet conveying path 19, an entrance roller pair 20, two or more conveyer roller pairs 21, a discharge roller pair 22, and the like are disposed in this order from the upstream side. Adjacent to the entrance roller pair 20, a flapper 36 (directing means) is disposed to direct the sheet S toward a guide portion 33 which branches out from the sheet conveying path 19. When the aforementioned directing means 36 is activated, the sheet S is directed into the guide portion 33, and when not, the sheet S is conveyed straight through the conveying path 19**.

On the downstream side of the guide portion 33, a sheet aligning tray 41 with an upper guide plate 43 is disposed. At the lower end side of the sheet aligning tray 41, an aligning member 59 against which the sheets S are aligned is disposed. The sheets S having discharged into the sheet aligning tray 41 by the conveyer roller pair 39 are aligned against the aligning member 59 as they are bumped against the aligning member 59 by an edge nudging member (nudging means) 49 comprising a rotating belt pivotable about one end (the upper end in the drawing).

As for the sheet alignment in the widthwise direction, the sheets S are aligned as they are bumped against an unillustrated referential wall or the like by a shifting means 50. A fan (air blowing apparatus) 46 disposed above the top guide plate 33 holds down the sheets S delivered into the aligning tray 41, by means of blowing air onto them, so that the folded sheets S are prevented from unfolding. A reference numeral 53 designates a clamping member for clamping a set of a predetermined number of sheets.

A reference numeral 42 designates an auxiliary guide plate for the sheet sets, and 55 designates a stopper finger, which is activated to hold temporarily first several sheets of the following sheet set after a sheet set equivalent to a single book is stored.

As the set of sheets equivalent to a single book are delivered into the aligning tray 41, and then are aligned there, the Clamping member 53 is activated to clamp a sheet set S1. When two or more books are to he made, the stopper finger 55 is also activated at the same time as the clamping member 53, to hold temporarily the first several sheets of the following sheet set until the sheet set S1 is aligned, clamped by the clamping member 53, and discharged from the aligning tray 41.

Next, tee Clamping member 53 clamping the sheet set S1 is moved straight to a spine attachment position H in such a manner as not to subject the sheet set to excessive stress. At this time, the bottom surface of the sheet S1 is guided by the auxiliary guide plate 42, which is moved substantially in synchronism with the movement of the clamping member 53, from underneath the aligning tray to a location near the spine attachment position H, at substantially the same speed as the clamping member 53, in parallel to the sheet set S1.

After the sheet set S1 is moved out of the aligning tray 41 by the clamping member 53, the aligning member 52 is returned to the aligning position, and the stopper finger 55 is retracted to a retracting position from the sheet binding position, allowing the several sheets having been held by the stopper finger 55 to be placed in the aligning tray 41 and aligned together with the sheets S3 which are delivered in succession into the aligning tray The sheet set S1 clamped by the clamping member 53 is moved straight to the spine attacker position H, with its bottom surface being supported the auxiliary guide plate 42, so that it is moved without being subjected to excessive stress.

It should be noted here that the distance between the aligning member 59 and a heater 56 is more the the width of the sheet set to be bound.

Figures 3A, 3B:
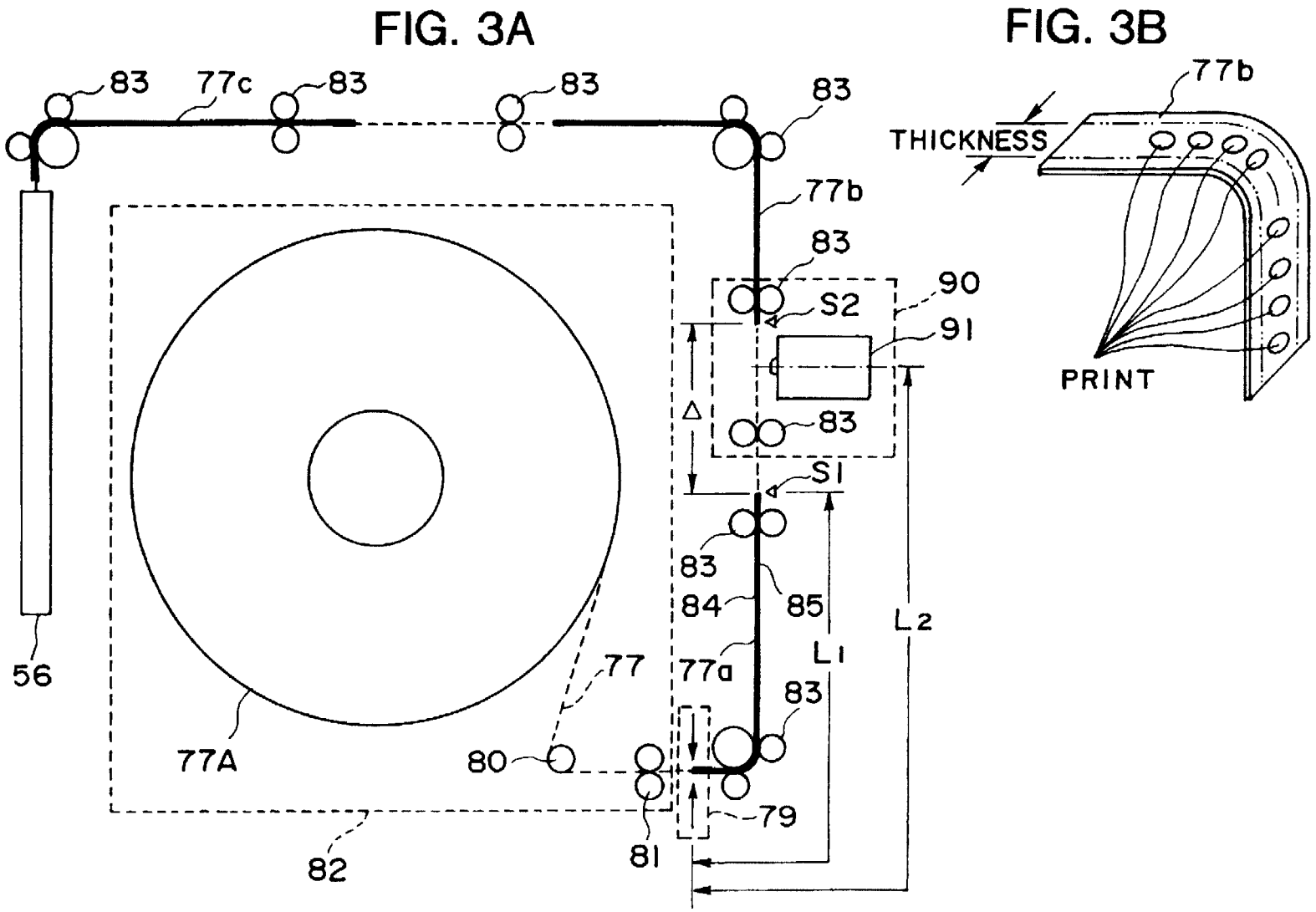
FIG. 3(*a*) is a plan view of the tape supplying section of the book making apparatus, as seen from the direction of an arrow mark A in FIG. 2(*a*), and FIG. 3(*b*) is a perspective view of binding tape 77*b*, shown in FIG. 3(*a*).

Referring to FIG. 3(*a*), the binding tape 77 rolled out of a tape reel 77A is cut by a cutter 79. Then, the cut piece of the binding tape 77 is sent to. the printing section, where the letters and the lake are printed on the back surface thereof. Next, the cut binding tape 77 is delivered from the height of the tape reel 77A to the height of a tape heating apparatus 56 by a tape delivery carriage. Finally, the cut binding tape 77 is delivered from within the carriage to the tape heating apparatus 65, ending the tape supplying step.

Next, the tape heating apparatus 56 is moved toward the tape to start the preliminary heating of the binding tape 77. The aforementioned sheet set S1 is moved to the spine attachment position H (FIG. 2(*a*)) with the same timing as the heating of the binding tape 77; the sheet set is moved to the position H from the tray 41 to be bound, on the spine side. After the spine side of the sheet set S1 is bound, the tape guide begins to be retracted, and at the same time, side heaters 51 and 52 begin to bind the front and back side edges of the sheet sets, in a manner of folding the edges of the binding tape 77 onto the front end back side edges, respectively. In order to finish the bent (folded) portions of the binding tape 77, a pressure is applied to the side edge portion of the sheet set by the side heater 51 and 52 (FIG. 2(*b*)), and this pressure from the side heaters 51 and 52 is removed after the binding is completed.

Next, the bound sheet set, that is, a finished product, is retracted from the spine attachment position H by the clamping member 53, that is, the sheet set conveying means, and then, is delivered to a position, where it is transferred onto the carriage 60.

As for the carriage 60, while the sheet set is bound at the spine attachment position H, the sheet supporter rod 605 sheet set rear edge supporter plate 604 of the carriage 60 are rotated about the rotational axis 606. The sheet set supporter rod 605 supports the bottom surface of the sheet set, together with the auxiliary guide plate 42 (sheet set supporter rod 605 is moved in the direction of an arrow mark D in FIG. 2).

After the completion of the binding step, the bound sheet set is moved in the direction of an arrow mark C by the clamping member 53 (FIG. 2(*a*)), being separated from the heater. Thereafter, the sheet set rear edge supporter plate 604 is moved into the space between the lifted sheet set edge portion and heater.

The sheet set supporter rod 605 is further moved in the D direction (FIG. 2(*a*)) so that the bottom surface of the sheet set is supported by the sheet set supporter rod 605 alone. Thereafter, the clamping member 53 and auxiliary guide plate 42 are returned toward the aligning tray 41.

Since the sheet set is lifted by the sheet set supporter rod 605 above the locus which the auxiliary guide plate 42 follows, the clamping member 53 and auxiliary guide plate 42 can be returned to the aligning tray 41 without touching the bottom surface of the sheet set.

After the clamping member 53 and auxiliary guide plate 42 are returned to the aligning tray 41, the sheet set supporter rod 605 and sheet set rear end supporter plate 604 are rotated in the direction of an arrow mark E (FIG. 2(*a*), placing the sheet set horizontally, so that the sheet set can be horizontal when it comes in contact with the conveyer belt 61.

The finished product on the carriage 60 is stored into the stacker 71 or 72 by the conveyer belt 61 and rear end pusher member (sheet set rear edge supporter plate) 604. When the finished product is not to be stored in the stacker 71 or 72, it is discharged from the second discharge opening 139. The stackers 71 and 72 are provided with a handle, which can be engaged with the locking device within the apparatus. Since two stackers are provided as described above so that one of the stackers can be manually pulled out while the finished products are stacked in the other, it is possible to sample the finished products, or to take out the finished products from the completely filled stacker, without stopping the binding operation of the book making apparatus.

Next, the tape supplying section will be described in detail. FIG. 3(*a*) is a plan view of the tape supplying section illustrated in FIG. 2(*a*), as seen from the direction of the arrow mark A.

The binding tape 77 rolled out of the tape reel 77A is sent by way of a tensioner 80 with a flange and is held by a first pinch roller 81. The first pinch roller 81 is disposed near the tape reel 77A and the section Indicated by a dotted line is in the form of a cassette; therefore, the tape reel 77A can be replaced outside the main assembly of the book making apparatus, improving the efficiency in the tape reel 77A replacement operation.

The binding tape 77 fed out by the first pinch roller 81 is cut to a predetermined length by the cutter 79. The cut binding tapes 77*a*, 77*b* and 77*c*, which now are in the form of a cut sheet, are conveyed to the tape heating apparatus 56 by two or more pairs of conveyer roller 83, where the trailing end is pushed in by a pusher finger to a predetermined position. As for the conveying means, the conveyer roller pairs 83 may be replaced with a conveyer belt pair, or a combination of a driving conveyer belt and follower roller pairs.

While tile binding tapes 77*a*, 77*b* and 77*c* are conveyed from the completely 79 to the tape heating means. the tape is passed through the printing section 90, in which printing is made on the tape, on the plane surface side 85, that is, the opposite side of the adhesive coated side, by printing head 91. During the period from when the leading end of the binding tape 77*b* passes the printing head 91 to when the trailing end of the binding tape 77*b* passes the printing head 91, the binding tape 77*b* is conveyed at a precisely constant speed.

The binding tape 77*a* must be stationary when it is cut by the cutter 79; therefore, in order to convey the binding tape without stopping the tape while the printing is made on the tape, the following condition must be satisfied:

$L2<L1+\delta$ and $L2>L1$

L1: length of cut binding tape

L2: length of path from cutter 79 to printing head 91

$\delta$: intervals between cut binding tapes

The printing section 90 is disposed at a location which satisfies the above condition. When the above condition is satisfied, the flow of the binding tape 77*b* is as follows.

The leading end of the binding tape 77 rolled out of the tape reel 77A is delivered beyond the cutter 79 by the first pinch roller 81 and two or more conveyer roller pairs 83. As the length of the binding tape beyond the cutter 79 reaches a predetermined length of L (length may be detected by a sensor S1, or may be counted by a counter), the binding tape 77 is temporarily stopped to be cut into the binding tape 77*b*. Next, only the conveyer rollers 81 are driven, with the first pinch roller 81 remaining stationary, to convey further the binding tape 77*b*. As the leading end of the binding tape 77*b* reaches the printing head 91 of the printing section 90 (arrival is detected based on the counter from the sensor S1), printing is started. As the distance between the trailing end of the binding tape 77*b* and the leading end of the following binding tape 77*a* reaches the predetermined length of (distance may be detected by a sensor S2, or may be detected by a counter), the first pinch roller 81 also begins to be driven in synchronism with the conveyer roller pairs 83. Before the length of the portion of the binding tape 77 being extended from the cutter 79 reaches the length of L, when the binding tape 77 is to be stopped to be cut to make the binding tape 77*a*, printing on the binding tape 77*b* is completed, and the leading end of the binding tape 77*b* passes the printing head 91 of the printing section 90.

Meanwhile, the printed surface of the binding tape 77*c* is dried while the tape 77*c* is conveyed from the printing section 90 to the entrance of the tape heating apparatus 56. The conveying path from the printing section 90 to the entrance of the tape heating apparatus 56 is given a sufficient length to secure drying time, or the distance between the binding tapes 77*b* and 77*c* may be shortened to delay the arrival time at the entrance of the tape heating apparatus 56. Also, a drying means, which uses the heat from the tape heating apparatus 56 or the like, may be provided between the printing section 90 and the entrance of the tape heating apparatus 56.

Figure 4:
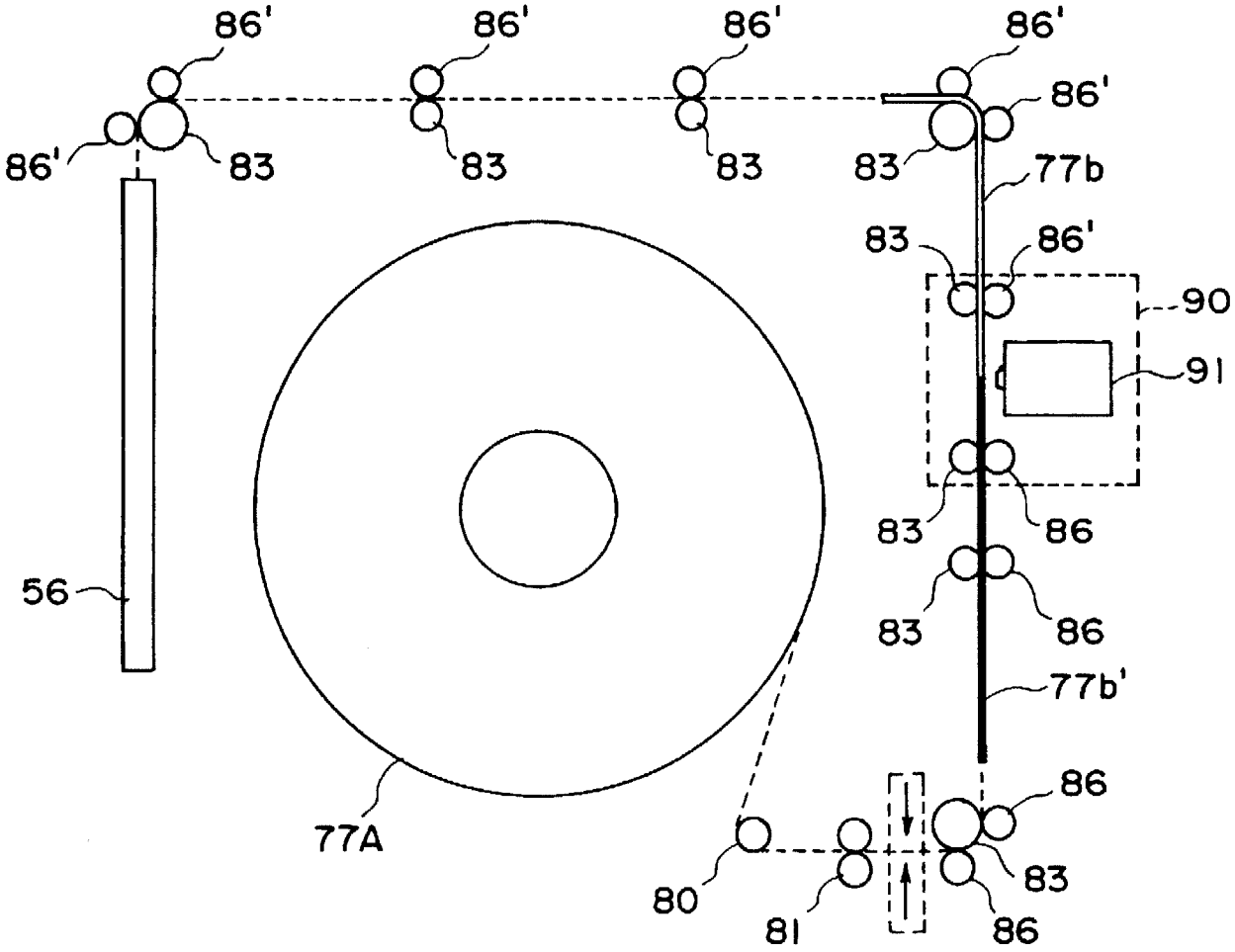
FIG. 4 is em explanatory drawing describing the tape movement in the printing section.

FIG. 4 is an explanatory drawing depicting means for multi-layer or wide width printing. The binding tape 77*b*, the surface of which has been printed from the leading end to the trailing end, can be moved backward to a position 77*b*.' by means of rotating in reverse the reversible conveyer roller pairs 83. Both holding rollers 86 and 86' are recessed across the center portion of the contact surface to prevent them from touching the printed areas, so that the wet portions of the printed binding tape 77*b* are not contaminated. The printing head 91 is slidable in the forward and backward directions relative to the surface of the drawing, which allows the printing head 91 to print repeatedly on the binding tape 77*b* which is repeatedly moved forward and backward by the conveying roller pairs driven, repeatedly forward and backward. Therefore, possible to print on the area wider than the head width of the printing head 91. Further, productivity can be improved by means of making it possible to print even while the binding tape 77*b* is moved backward.

Figure 5:
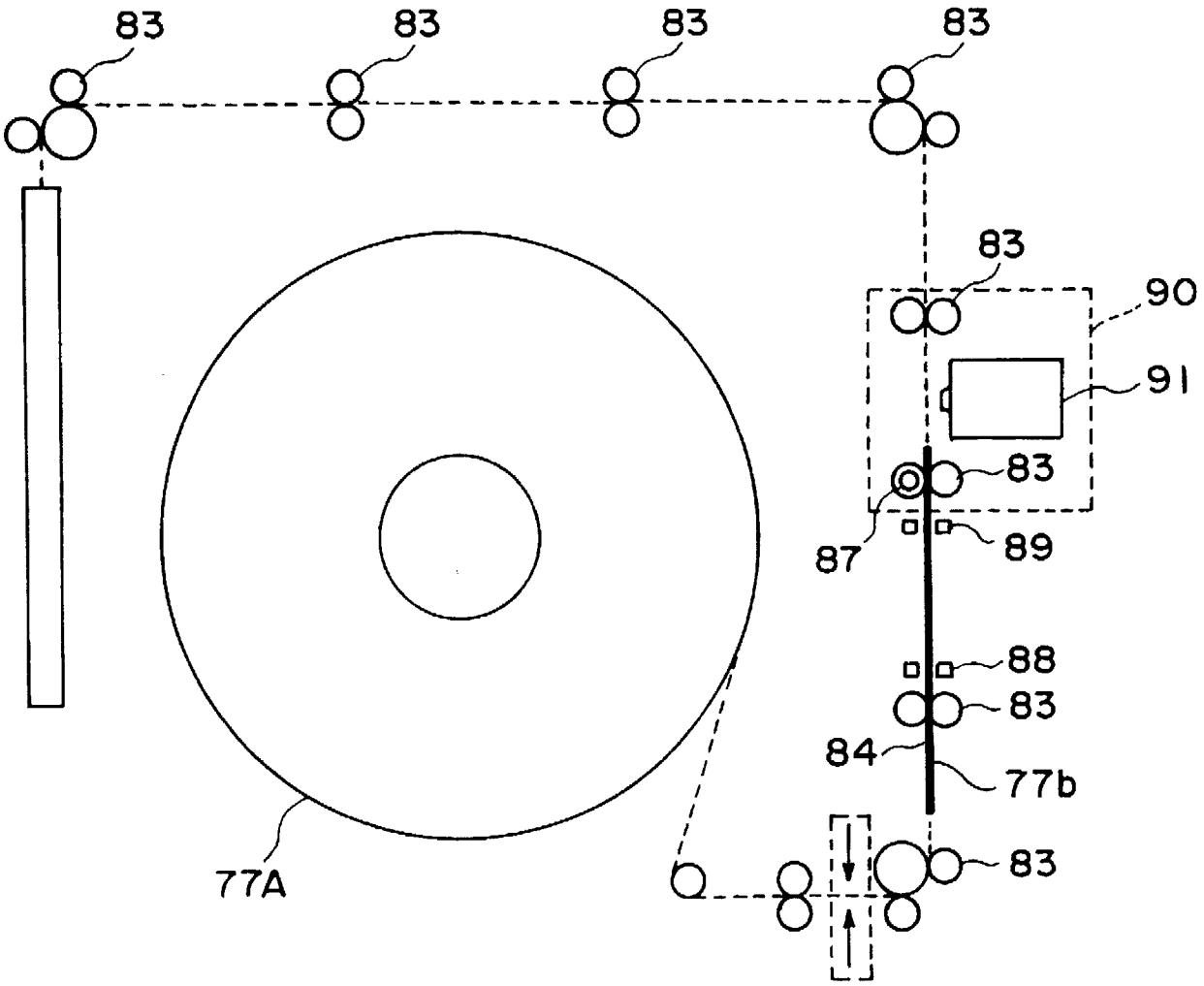
FIG. 5 is a detailed drawing of the printing section and its adjacencies, in the tape supplying section.

FIG. 5 is a detailed drawing of the printing head section and its adjacencies.

In order to detect the conveying speed of the binding tape 77*b* passing by the printing head 91, the roller, which is located immediately before the printing head to hold the adhesive coated side (surface with a higher friction coefficient) of the binding tape 77*b*, is used is in encoder roller 87. With this arrangement, as the conveyance speed of the binding tape 77*b* is detected by the encoder 87, information for correcting the conveyance speed to a predetermined one is transmitted to a motor which drives the conveyer roller pairs 83, correcting thereby the conveyance speed of the binding tape. Further, the information about the binding tape 77*b* conveyance speed detected by the encoder 87 is transmitted to the printing head 91 of the printing section 90 so that the printing speed can be corrected to be synchronized with the tape conveyance speed.

As for other means for detecting the tape conveyance speed, there are the following means.

Referring to FIG. 5, optical sensors 88 and 89 for detecting the passage of the leading end of the binding tape 77*b* are disposed at different locations to calculate the conveyance speed of the binding tape 77*b* being conveyed, on the basis of the time it takes for the leading end of the binding tape 77*b* to travel from one sensor to the other. The speed information thus obtained is used to synchronize the printing speed of the printing section 90 as described above.

Figure 6:
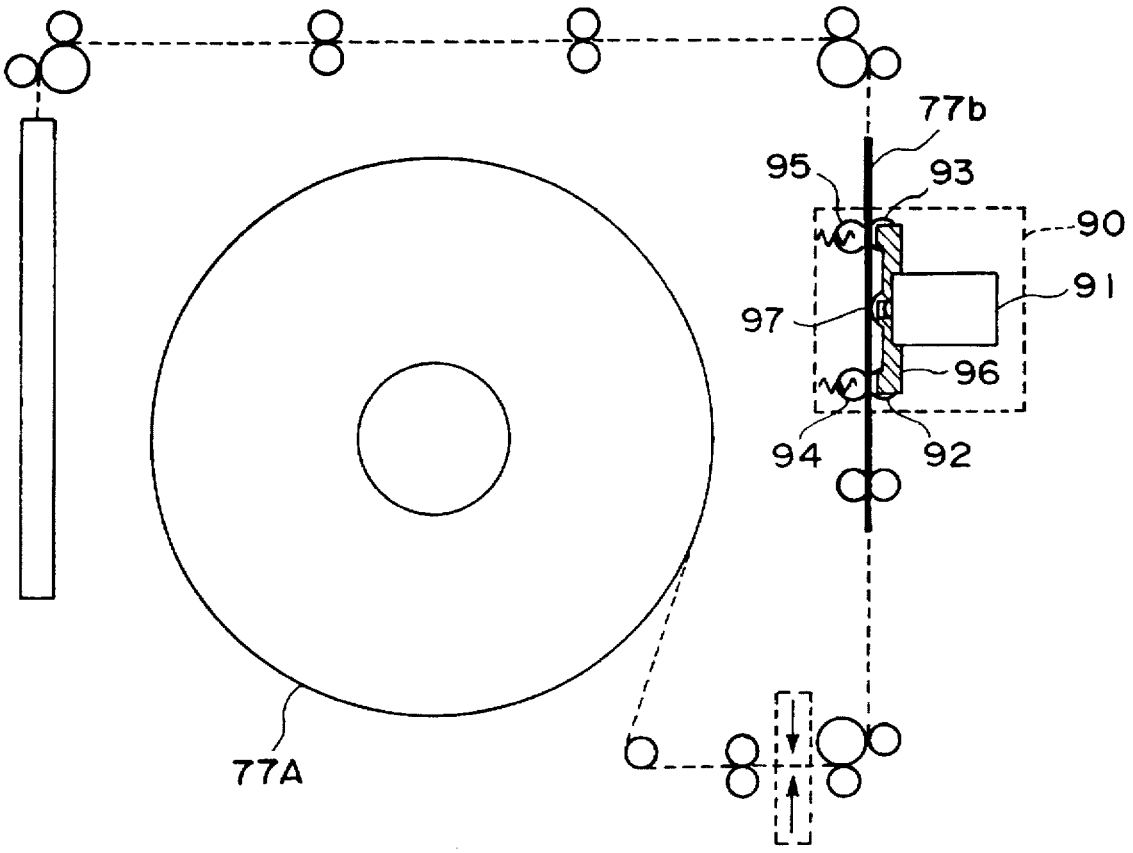
FIG. 6 is a detailed drawing of the printing section and its adjacencies, in the tape supplying section.

FIG. 6 is a detailed drawing of the printing section 90.

The binding tape 77*b* is held and conveyed by two roller pairs, which are constituted of combinations of support rollers 92 and 93, and pressing rollers 94 and 95, respectively. The printing head 91 is supported by a frame member 96 which accurately positions the tip of the printing head 91, and the supporting rollers 92 and 93. From the frame member 96, a bumper member 97 is extended to surround the printing head 91 to protect it.

When it is necessary to change the sizes of the letters or logos to be printed, there will be no problem as long as the printing head size is larger than the maximum sizes (MAX) of the letters or logos to be printed, but the letter or logo size larger than the printing head 91 size creates a problem. However, this problem can be solved by means of making the printing head 91 movable. That is, the letters, logos, or the like having a size larger than the printing head 91 size can be printed by means of moving both the binding tape and printing head 91.

Figure 7:
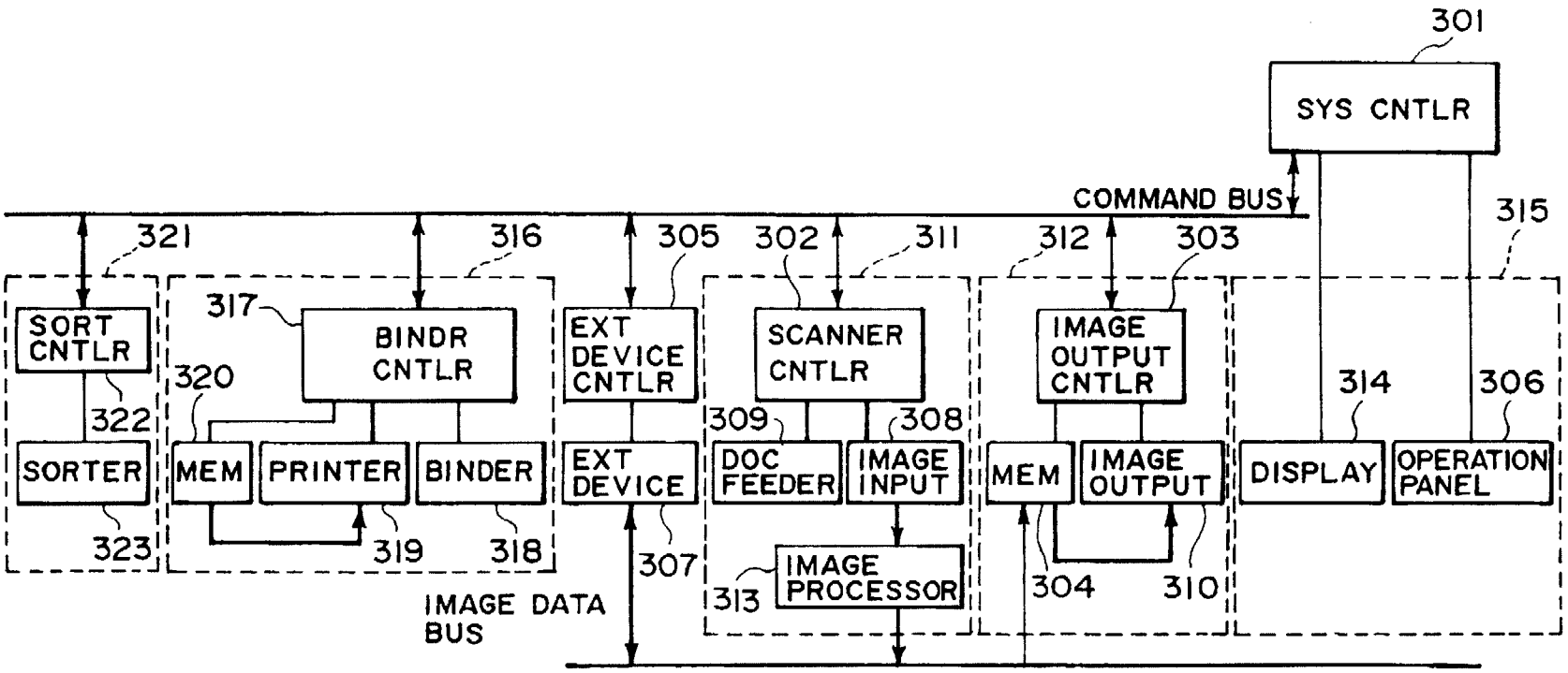
FIG. 7 is a block diagram of the structure of the on-line a apparatus.

FIG. 7 is a block diagram of the structure of an embodiment of the on-line system in accordance with the present invention. The operation for printing on the spine surface will be described with reference to this drawing.

In FIG. 7, a reference numeral 301 designates a system controller for controlling the overall operation of a copying machine, which controls the overall operational sequences of the system on the basis of the information inputted by an operator through a control panel 306. A reference numeral 302 designates a scanner controller, which controls an image input apparatus 308 for converting the information from the original into the imaging data, and also controls an original feeding apparatus 309 for feeding the original containing multiple sheets. A reference numeral 303 designates an image output controller comprising an image outputting apparatus 310. The image outputting apparatus 310, which has a large capacity memory 304 for storing the imaging data, and two or more recording sheet cassettes storing sheets of different sizes, outputs the image data as a visible image on the recording sheet in response to a printing command. A reference numeral 311 designates a scanning section, which reads in the image, and processes the read image information in an image processing section 313. A reference numeral 312 designates an image outputting section.

A reference numeral 314 designates a display panel for displaying various internal information of the main assembly of the book making apparatus; 315, a control/display panel comprising the display panel 314 and control panel 306; 305, an external device controller, which controls the data exchanges between the external device such as printer systems, LANs or the like, and the main assembly; 306, a binding section for banding the conveyed sheets or sheet sets; 317, a bookbinding controller, which controls a binding apparatus 318, and a printing apparatus 319; 321, a sorting section for sorting the conveyed sheets or sheet sets; and 322 designates a sorting controller, which controls a sorting apparatus 323.

The operator is to set the original on the original feeding apparatus 309, and to select an output mode using the control panel 306. After the letters, logos or the like to be printed on the spine surface are selected An the output mode, the original is circulated through the original feeding apparatus 309 to count the number of the sheets in the original.

The number of the sheets in the original counted by the original feeding apparatus 309 is displayed on the display panel 314, so that, when the number of the sheet in the original is within a range bindable by the binding apparatus 318, the letters, logos and the like to be printed can be inputted through the control panel 306. The letters, logos, and the like inputted by the operator are displayed on the display panel 314. At this time, the estimated thickness of the bound sheets calculated from the number of the sheets in the original counted by the original feeding apparatus 309 is displayed in a frame on the display panel; therefore, the operator can select printing position, letter size, and the like in view of the estimated thickness of the finished (bound) sheet set. It should be noted here that the upper limit of the letter size is regulated to be less than the thickness of the estimated thickness of the bound sheet set. In other words, letter sizes exceeding the estimated thickness of the bound sheet set cannot be selected. As the printing data and a copy start signal are inputted through the control panel 306, they are transmitted to the system controller 307, which carries out computation to allocate various operations to various apparatuses, according to the inputted data, and transmits to the scanner controller 302 a command to drive the optical system, to read the imaging data, and to carrying out the like operations. The scanner controller 302 having received the command sequentially feeds the sheets from the original placed on the original feeding apparatus 309, onto the surface of the original placement table of glass, in response to the inputted information, and drives the optical system in the image input apparatus 308 to read the images in the original. The imaging data is transmitted to the image processing section 313. The image processing section 313 having received the imaging data carries out various image processing processes such as enlargement, reduction, rotation, or the like, and inputs the processed imaging data into the large capacity memory 304. After the imaging data for all the sheets in the original are transmitted, a signal indicating the completion of the image reading is transmitted to the system controller 301. The system controller 301 having received the image reading completion signal sends out to the image output controller 303, a command to start the image formation. The image output controller 303 having received the image formation start command retrieves, page by page, to imaging data having been stored in the large capacity memory 304 through the preceding step of the copying operation, and forms images on the delivered recording sheet, in response to the retrieved imaging date. After the images are fixed, the recording sheets are discharged to a designated location. After the image formation is completed, the image output controller 303 sends a signal indicating the completion of the image formation to the system controller 301.

Further, commands regarding the binding and printing are transmitted from the system controller 301 to the binding controller 317, to carry out the binding and printing operations.

Further, a sorting command is transmitted to the sorting controller 322, to carry out the sorting operation. As soon as the operations in the various apparatuses are completed, the apparatuses transmit signals indicating the completion of the operations to the system controllers 301, and then, the system controller 301 sends signals indicating the completion of the operations in the various apparatuses to the control panel 306, displaying the completion of the operations on the display panel 314.

In this embodiment, the number of the sheets in the original is counted to estimate the thickness of the bound sheet set, but when the number of the sheets is known in advance, the operator may input the number of the sheets through the control panel.

Also in this embodiment, the thickness of the bound sheet set is estimated from the number of the sheets in the original. However, the thickness may be actually measured by means of placing a thickness detection sensor within the aligning tray of the binding apparatus, or on the gripper for conveying the sheet set (sheet set thickness is obtained as the distance between the top and bottom portions of the gripping means), and the spine printing data may be inputted according to this actually measured thickness.

As is evident from the above description, according to the present invention, the sizes of the letters, logos, and the like to be printed can be optionally elected within a regulated range, effecting thereby reliable placement of the printed letters, logos, and the like within the border line of the spine surface.

Also in this embodiment, the printing section is disposed within the tape supplying section, but it may be disposed at the spine attachment position H, or on the carriage 60, so that printing made on the spine portion of a finished book, that is, the sheet set bound in the form of a book.

Figure 8:
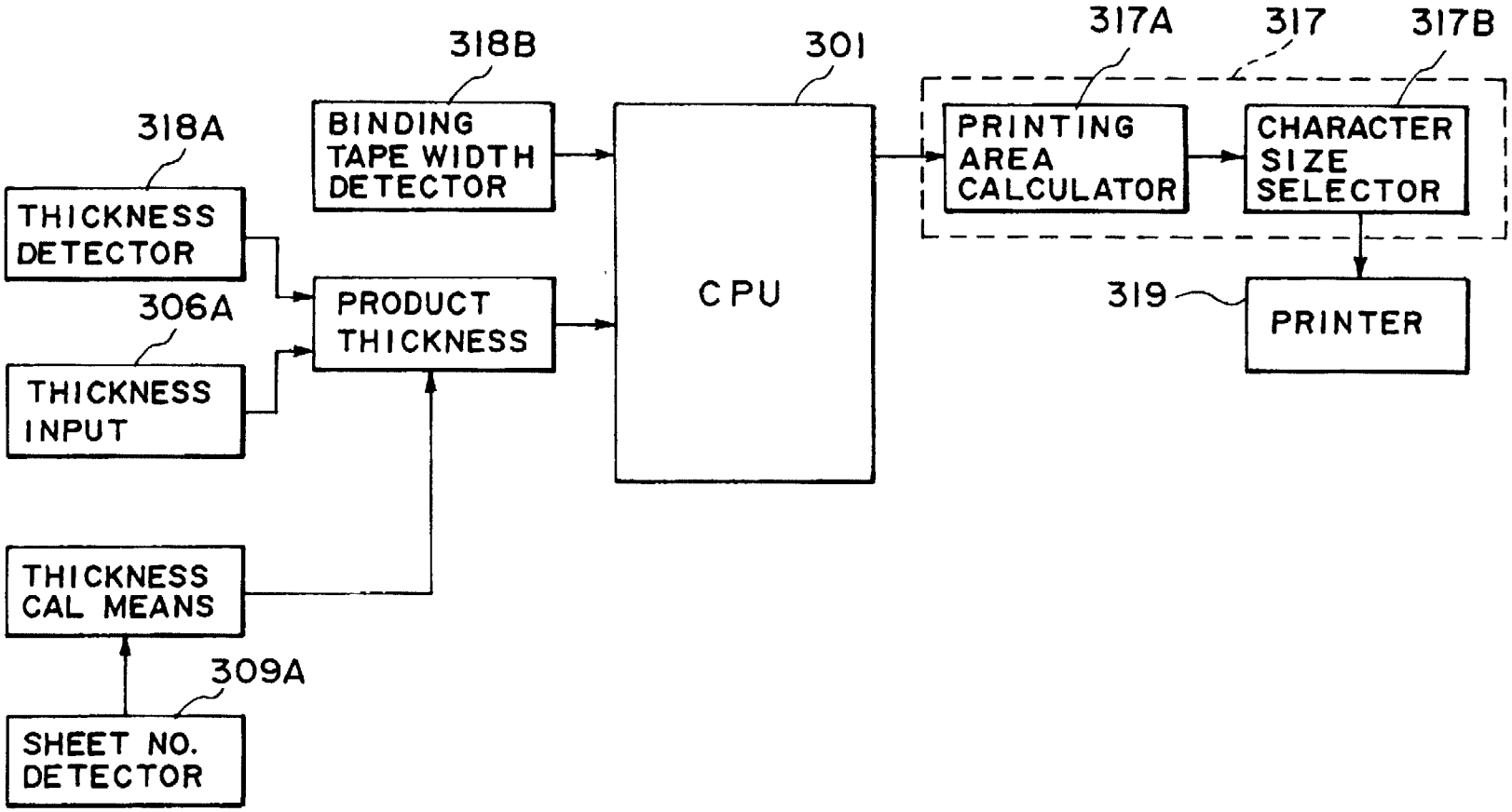
FIG. 8is a block diagram of the printing control section.

FIG. 8 is a block diagram for printing control. The information about the sheet set thickness which is calculated by a sheet set thickness calculating means based on the results of the detection by an original sheet count detecting means 309A disposed within the original feeding apparatus 309, the information about the sheet set thickness, which is inputted through the sheet set thickness inputting means 306A of an input means 306, or the information about the sheet set thickness, which is inputted from the sheet set detecting means 318A disposed within the binding apparatus 318 to detect actually the thickness of the sheet set to be bound, is inputted to the system controller 301. Further, the information about the width of the binding tape from the banding apparatus 318 is inputted to the system controller 301 by a detecting means 318B.

The aforementioned information is transmitted from the system controller 301 to the binding operation controller 317, and printable sizes of the letters, logos and the like are calculated by the portable image size calculating means of the binding operation controller 317. Based on the values obtained through the calculations described above, the letters, logos, and the like having optimum sizes are selected by a size selecting means 317B, and the printing operation is carried out by the printing apparatus 319 in response to the selected sizes.

As described above, a printing data inputting means can be used for selecting desirable sizes for the letters, logos, and the like; therefore, it is possible to bind a set of sheets into the form of a book, on the spine of which the letters, logos, and the like of the desirable sizes have been printed.

Further, the thickness of the sheet set to be bound is detected by the sheet set thickness detecting means before or after the sheet set is bound into the form of a book, and the detected thickness is used to regulate the sizes of the letters, logos, and the like, which can be inputted through the printing data inputting means; therefore, even when the thickness of the sheet set to be bound changes (even when the size of the printable area changes), the letters, logos, and the like are prevented from being printed outside the printable area, or from being only partially (incompletely) printed.

Further, the sheet set thickness is detected by the sheet set thickness detecting means disposed within the binding apparatus before or after the sheet set is bound into the form of a book, and the detected thickness is used to regulate the sizes of the letters or the like, which can be inputted using the print data inputting means disposed within an apparatus connected to the binding apparatus through an interface; therefore, even when the size of the printable area changes due to the thickness change of the sheet set to be bound, the letters or the like are prevented from being printed outside the printable area, or from being only partially (incompletely) printed. In addition, the print data inputting means may be provided on an apparatus to which the bending apparatus is connected, for example, an image forming apparatus, instead of the binding apparatus itself. In other words, the print data (sheet size, number of sheets, and the like) inputting means of the apparatus to which the binding apparatus is connected may be shared as the print data inputting means for the binding apparatus.

Further, outline fonts may be contained in the printing means, so that printing can be made using preferable fonts.

Further, the actual detection of the sheet set thickness may be replaced by the sheet set thickness computation based on the number of the sheets to be bound, and the thickness of a single sheet. In this case, it is unnecessary for the operator to input the letter size or the like after a set of sheets are accumulated or a sheet set is bound (spine is yet to be printed).

Next, the recording means will be described.

The recording means is to record ink images on a recording sheet delivered by the conveying means. As for the recording means in the apparatus of this embodiment, an ink jet recording apparatus is preferably employed.

The ink jet recording system comprises: liquid ejecting orifices for ejecting recording ink liquid as flying ink droplets; liquid passages connected to the liquid ejecting orifices; and ejectting energy generating means, which is disposed within a portion of the liquid passage to generate the ejectting energy for causing the ink within the liquid passage to fly out. It drives the ejectting energy generating means in response to the imaging signals, to eject the ink droplets to form images.

As for the ejectting energy generating means, there are various methods: a method which employs pressure energy generating means, that is, an electro-mechanical transducer such as piezo-electric element; a method which employs electromagnetic energy generating means to be used for irradiating electromagnetic wave such as laser beam on the ink liquid, so that the ink liquid is ejected by the function of the heat generated by the electromagnetic wave absorbed in the ink liquid; a method which employs thermal energy generating means such as an electrothermal transducer to be used for heating the ink so that the ink is ejected; and the like. Among these methods, the method which employs the thermal energy generating means such as an electrothermal transducer to eject the ink is preferable. This is due to the following reasons. Since the method allows the liquid ejecting orifices to be arranged in high density, high resolution images can be recorded, and also, the recording head size can be reduced.

In this embodiment, a serial type bubble jet recording system, which is one of the aforementioned ink jet recording systems, is employed as the recording means.

Figure 9:
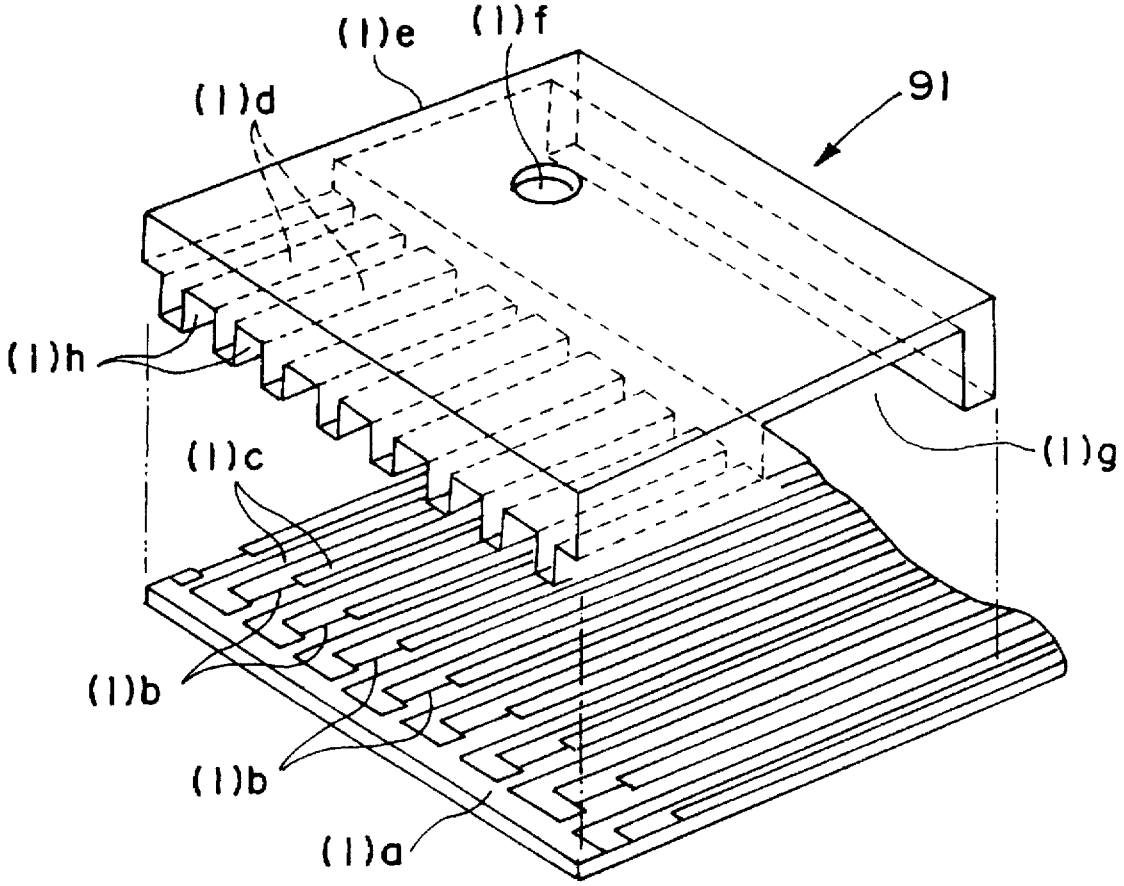
FIG. 9 is an exploded view of a recording head.
Figure 10A:
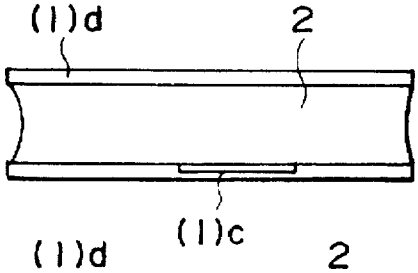
FIG. 10(*a*)–10(*g*) are explanatory drawings describing the bubble jet recording principle.
Figure 10B:
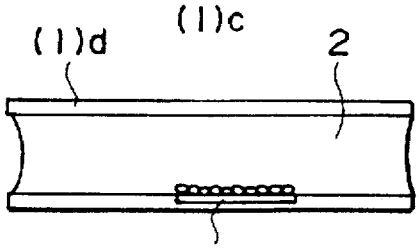
Figure 10C:
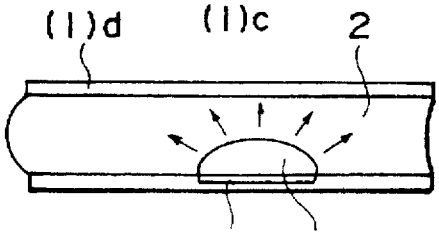
Figure 10D:
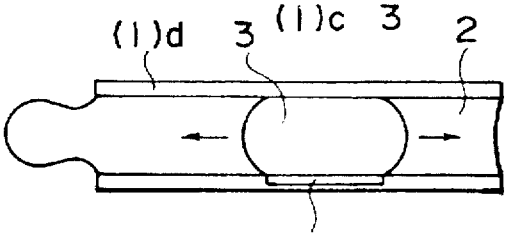
Figure 10E:
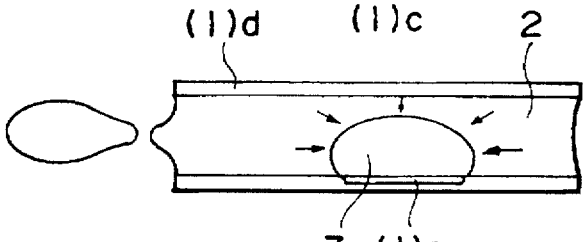
Figure 10F:
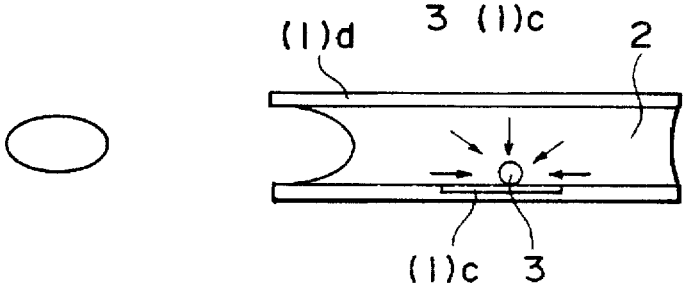
Figure 10G:
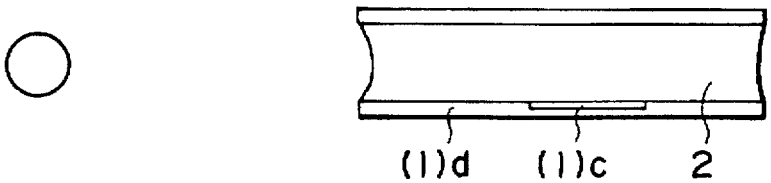

FIG. 9 is an exploded view of a recording head (1) constituting the recording means, and FIG. 10(*a–g*) are explanatory drawings describing the bubble jet recording principle. The typical structure and principle are disclosed in U.S. Pat. Nos. 4,723,129, and 4,740,796, for example.

In FIG. 9, an alphanumeric reference 1*a* designates a heater board comprising a silicon substrate, electrothermal transducers 1*b* (ink ejectting heater), and electrodes 1*c* of aluminum or the like for supplying electric power to the electrothermal transducers 1*b*. The electrothermal transducers 1*b* and electrodes 1*c* are formed on the silicon substrate using the film deposition technology. A top plate 1*e* with partitioning walls for partitioning the recording liquid passages 1*d* (nozzles) is glued to the heater board 1*a* to complete a recording head. At a predetermined location within the apparatus, an ink cartridge is replaceably mounted to supply the ink to the recording head 1.

The ink supplied from the ink cartridge through a tube is filled into a common liquid chamber 1*g* within the recording head, through an ink supply port 1*f* of the top plate 1*e*, and then, is led into each nozzle 1*d* from this common liquid chamber 1*g*. Each nozzle 1*d* is provided with an ink ejecting orifice 1*h*. The ink ejecting orifices 1*h* are aligned with a predetermined pitch in the sheet conveyance direction.

In this embodiment, the recording head 1 structured as described above is mounted on a reciprocating carriage, and the ink is ejected from the recording head 1 in synchronism with the carriage movement, to effect recording.

Next, the ink ejecting principle of the bubble jet recording system will be described with reference to FIGS. 10(*a–g*).

When not printing, the surface tension of the ink filled in the nozzle 1*d* and the external pressure are balanced at the ejecting orifice as illustrated in FIG. 10(*a*). In order to eject the ink in this state, electrical power is supplied to the eletrothermal transducer 1*b* within the nozzle 1*d* to increase abruptly the ink temperature beyond the nucleate boiling point. As a result, microscopic bubbles develop in the heated ink next to the electrothermal transducer 1*b* as illustrated in FIG. 10(*b*), and the ink next to the heating portion is vaporized to trigger the film boiling, causing a bubble 3 to grow suddenly as shown in FIG. 10(*c*).

As the bubble 3 grows to the maximum size as shown in FIG. 10(*d*), the ink liquid droplet is pushed out from the ejecting orifice of the nozzle 1*d*. Next, as the power supply to the electrothermal transducer 1*b* is stopped, the expanded bubble 3 contracts as it is cooled by the ink 2 within the nozzle 1. The ink liquid droplet is ejected out of the ejectting orifice due to the expansion and contraction of this bubble. Further, referring to FIG. 10(*f*), as the ink makes contact with the surface of the electrothermal transducer 1*b*, it is quickly cooled, end as a result, the bubble 3 either disappears or contracts to a substantially neglegible volume. As the bubble 3 contracts, the ink is supplied into the nozzle 1*d* from the common liquid chamber 1*g* due to capillarity, readying the recording head for the following application of the power supply.

Thus, the ink images are recorded on the recording sheet by means of supplying the electric power to the, electrothermal transducer 1*b* in response to imaging signal in synchronism with the reciprocative movement of the carriage.

The invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A bookbinding apparatus comprising:

pasting means for pasting a bookbinding spine cover sheet on a sheet set;

printing means for printing an image on the bookbinding spine cover sheet;

inputting means for inputting data to be used for printing the image by said printing means, wherein when the data are inputted through said inputting means, the sizes of the image to be printed on the bookbinding spine cover sheet by said printing means are selectable;

thickness detecting means for detecting the thickness of the sheet set to be bound; and regulating means for regulating the sizes of the image to be printed on the bookbinding spine cover sheet, in response to the thickness detected by said thickness detecting means.

2. A bookbinding apparatus in accordance with claim 1, wherein said printing means prints the image on the bookbinding spine cover sheet before the bookbinding spine cover sheet is pasted on the sheet set by said pasting means.

3. A bookbinding apparatus in according with claim 1, wherein said printing means prints the image on the bookbinding spine cover sheet after the bookbinding spine cover sheet is pasted on the sheet set by said pasting means.

4. A bookbinding apparatus in accordance with claim 1, wherein said thickness detecting means comprises sheet count inputting means for inputting the number of sheets to be bound, and calculating means for calculating the thickness of the sheet set from the values inputted through said sheet count inputting means.

5. A bookbinding apparatus in accordance with claim 1, wherein said thickness detecting means comprises a sensor for actually measuring the sheet set thickness after the bookbinding spine cover sheet is pasted on the sheet set be said pasting means.

6. A bookbinding apparatus in accordance with claim 1, further comprising: a tape reel on which a bookbinding spine cover sheet tape is wound, conveying means for conveying the bookbinding spine cover sheet tape from the tape reel to said pasting means, and cutting means for cutting the bookbinding spine cover sheet tape conveyed by the conveying means, to a predetermined length, wherein said printing means prints the image on the bookbinding spine sheet cover while the bookbinding spine cover sheet is conveyed by the conveying means.

7. A bookbinding apparatus in accordance with claim 1, wherein said printing means is constituted of an ink jet printer.

8. A bookbinding apparatus in accordance with claim 1, wherein said pasting means comprises heating means for heating thermally meltable adhesive coated on the bookbinding spine cover sheet so that the bookbinding spine cover sheet can be pasted on the sheet set to bind it.

9. An on-line book making apparatus, which comprises an external device connected to a bookbinding apparatus, and controls said bookbinding apparatus based on the input from inputting means of said external device, said bookbinding apparatus comprising:

pasting means for pasting a bookbinding spine cover sheet on a sheet set;

printing means for printing an image on the bookbinding spine cover sheet, wherein when data to be used for printing the image by said printing means are inputted through said inputting means, the sizes of the image to be printed on the bookbinding spine cover sheet by said printing means are selectable;

thickness detecting means for detecting the thickness of the sheet set to be bound; and regulating means for regulating the sizes of the image to be printed on the bookbinding spine cover sheet, in response to the thickness detected by said thickness detecting means.

10. An on-line book making apparatus in accordance with claim 9, wherein said external device is constituted of an image forking apparatus for forming image on a sheet material, and said bookbinding apparatus sequentially receives the sheets on which the image has been formed by said image forming apparatus, accumulating the sheets into a sheet set which are bound to form a book by pasting the bookbinding spine cover sheet.

11. An on-line book making apparatus in accordance with claim 10, wherein said thickness detecting means comprises sheet count inputting means for detecting the number of sheets in an original to be copied by said image forming apparatus, and calculating means for calculating the thickness of the sheet set from the results of the detection by said sheet count inputting means.

12. An on-line book making apparatus in accordance with claim 10, wherein said thickness detecting means comprises calculating means for calculating the sheet set thickness based on the values of the sheet count of the sheets to be bounded, which are inputted through said inputting means.

13. An on-line book making apparatus in accordance with claim 12, wherein said thickness detecting means comprises a sensor for actually measuring the sheet set thinness after the bookbinding spine cover sheet is pasted on the sheet set by said pasting means.

14. An on-line book making apparatus in accordance with claim 9, further comprising: a tape reel on which a bookbinding spine cover sheet tape is wound, conveying means for conveying the bookbinding spine cover sheet tape from said tape reel to said pasting means, and cutting means for cutting the bookbinding spine cover sheet tape conveyed by said conveying means, to a predetermined length, wherein said printing means prints the image on the bookbinding spine sheet cover while pieces of the bookbinding spine cover sheet are sequentially conveyed by said conveying means.

15. An on-line book making apparatus in accordance with claim 14, wherein said printing means is disposed on a tape reel side rather than on a downstream side of said printing means.

16. An on-line book making apparatus in accordance with claim 15, wherein said cutting means and printing means are disposed relative to one another so as to satisfy the following formula:

$L2<L1+\delta$ $L2>L1$

L1: length of binding tape cut by cutting means

L2: length of path from cutting means to printing means $\delta$:intervals between cut bookbinding spine cover sheet.

17. An on-line book making apparatus in accordance with claim 9, wherein said printing means is constituted of an ink jet printer.

18. An on-line book making apparatus in accordance with claim 9, wherein said pasting means comprises heating means for heating the thermally meltable adhesive coated on the bookbinding spine cover sheet so that the bookbinding spine cover sheet can be pasted on the sheet set to bind it.

* * * * *

UNITED STATES PATENT AND TRADEMARK OFFICE

CERTIFICATE OF CORRECTION

PATENT NO. : 5,735,659

DATED : April 7, 1998

INVENTOR(S) : Kosasa et al.

It is certified that error appears in the above-identified patent and that said Letters Patent is hereby corrected as shown below:

COLUMN 1:

Line 7, "specifically" should read --specifically,--;
Line 20, "farm" should read --form--;
Line 25, "spins" should read --spine--;
Line 40, "cover," should read --cover.--;
Line 56, "sheet:" should read --sheet;--; and
Line 65, "end" should read --and--.

COLUMN 2:

Line 16, "with" should read --with the--;
Line 25, "em" should read --an--;
Line 32, "a" should be deleted--;
Line 34, "FIG. 8is" should read --FIG. 8 is--;
Line 44, "resent" should read --present--;
Line 52, "reeds" should read --reads--;
Line 56, "sad" should read --and--; and
Line 65, "Sheet" should read --sheet--.

COLUMN 4:

Line 15, "Clamping" should read --clamping--;
Line 16, "he" should read --be--;
Line 22, "tee Clamping" should read --the clamping--;
Line 23, "H" should read --H,--;
Line 24, "stress," should read --stress.--;

UNITED STATES PATENT AND TRADEMARK OFFICE

CERTIFICATE OF CORRECTION

PATENT NO. : 5,735,659

DATED : April 7, 1998

INVENTOR(S) : Kosasa et al.

It is certified that error appears in the above-identified patent and that said Letters Patent is hereby corrected as shown below:

Line 38, "tray" should read --tray 41.--;
Line 45, "the the" should read --than the--;
Line 49, "to." should read --to--; and
Line 50, "lake" should read --like--.

COLUMN 5:

Line 12, "605" should read --605 and--; and
Line 60, "Indicated" should read --indicated--.

COLUMN 6:

Line 9, "tile" should read --the--; and
Line 10, "completely" should read --cutter--, and "means." should read --means,--.

COLUMN 7:

Line 4, "77b,'" should read --77b',--;
Line 13, "driven." should read --driven--;
Line 14, "possible" should read --it is possible--; and
Line 24, "is in" should read --as an--.

COLUMN 8:

Line 29, "banding" should read --binding--; and
Line 38, "An" should read --in--.

UNITED STATES PATENT AND TRADEMARK OFFICE

CERTIFICATE OF CORRECTION

PATENT NO. : 5,735,659

DATED : April 7, 1998

INVENTOR(S) : Kosasa et al.

It is certified that error appears in the above-identified patent and that said Letters Patent is hereby corrected as shown below:

COLUMN 9:

Line 20, "sheet," should read --sheets,--, and "date." should read --data.--.

COLUMN 10:

Line 9, "banding" should read --binding--.

COLUMN 11:

Line 6, "ejectting" should read --ejecting--;
Line 8, "ejectting" should read --ejecting--;
Line 9, "ejectting" should read --ejecting--;
Line 12, "ejectting" should read --ejecting--; and
Line 40, "ejectting" should read --ejecting--.

COLUMN 12:

Line 12, "ejectting" should read --ejecting--;
Line 16, "end" should read --and--;
Line 23, "the," should read --the--; and
Line 55, "according" should read --accordance--.

UNITED STATES PATENT AND TRADEMARK OFFICE

CERTIFICATE OF CORRECTION

PATENT NO. : 5,735,659

DATED : April 7, 1998

INVENTOR(S) : Kosasa et al.

It is certified that error appears in the above-identified patent and that said Letters Patent is hereby corrected as shown below:

COLUMN 13:

Line 1, "be" should read --by--.

Signed and Sealed this

Sixth Day of October, 1998

Bruce Lehman

*Attest:*

BRUCE LEHMAN

*Attesting Officer*

*Commissioner of Patents and Trademarks*